US009644246B2

(12) United States Patent
Elksnitis et al.

(10) Patent No.: US 9,644,246 B2
(45) **Date of Patent: *May 9, 2017**

(54) DEGASSER SNORKEL WITH SERPENTINE FLOW PATH COOLING

(71) Applicants: Andrew Elksnitis, Munhall, PA (US); Michael J. Sherman, Portage, IN (US)

(72) Inventors: Andrew Elksnitis, Munhall, PA (US); Michael J. Sherman, Portage, IN (US)

(73) Assignees: TYK America, Inc., Clairton, PA (US); Arcelormittal S.A. (LU)

( * ) Notice: Subject to any disclaimer, the term of this patent is extended or adjusted under 35 U.S.C. 154(b) by 135 days.

This patent is subject to a terminal disclaimer.

(21) Appl. No.: 14/681,595

(22) Filed: Apr. 8, 2015

(65) Prior Publication Data

US 2015/0315665 A1 Nov. 5, 2015

Related U.S. Application Data

(63) Continuation-in-part of application No. 13/466,462, filed on May 8, 2012, now Pat. No. 9,038,867.

(60) Provisional application No. 61/484,871, filed on May 11, 2011.

(51) Int. Cl.
*C21C 7/10* (2006.01)
*F27D 27/00* (2010.01)

(52) U.S. Cl.
CPC ..... *C21C 7/10* (2013.01); *F27D 27/00* (2013.01); *F27D 2027/002* (2013.01)

(58) Field of Classification Search
CPC ..... C21C 7/10; F27D 2027/002; F27D 27/00
USPC ..... 222/603, 595, 592; 266/208, 207, 209, 266/210, 286; 75/508, 509, 708, 511, 75/510
See application file for complete search history.

(56) References Cited

U.S. PATENT DOCUMENTS

| | | | | |
|---|---|---|---|---|
| 3,422,857 | A | 1/1969 | Napora | |
| 3,521,873 | A * | 7/1970 | Matsuda | F16L 59/12 266/209 |
| 3,572,541 | A | 3/1971 | Shapland | |
| 4,241,904 | A | 12/1980 | Nagashima et al. | |
| 4,637,034 | A * | 1/1987 | Grageda | C07D 233/70 373/76 |
| 5,024,421 | A | 6/1991 | Cooley | |
| 5,520,718 | A | 5/1996 | Keilman et al. | |
| 5,911,946 | A | 6/1999 | Aichinger et al. | |
| 6,537,485 | B2 | 3/2003 | Demukai | |
| 6,638,471 | B1 | 10/2003 | Wagener et al. | |

(Continued)

FOREIGN PATENT DOCUMENTS

| | | |
|---|---|---|
| JP | 57012803 | 1/1982 |
| JP | 58096813 | 6/1983 |

(Continued)

*Primary Examiner* — Scott Kastler
*Assistant Examiner* — Michael Aboagye
(74) *Attorney, Agent, or Firm* — Cohen & Grigsby, P.C.

(57) ABSTRACT

A snorkel (10) having a double shell core (16, 26) that defines an annular gap (40) between the shells and that has an array of baffles (66) arranged in the annular gap to define a serpentine flow path for cooling gases that pass through the annular gap. In an embodiment, a snorkel includes a flange (12) that defines an internal passageway (84) such that the fluid pathway through annular gap (40) includes passage of cooling medium through internal passageway (84).

11 Claims, 10 Drawing Sheets

(56) References Cited

U.S. PATENT DOCUMENTS

| | | | | |
|---|---|---|---|---|
| 8,268,233 | B2 | 9/2012 | Macrae | |
| 9,038,867 | B2 * | 5/2015 | Elksnitis | C21C 7/10 222/592 |

FOREIGN PATENT DOCUMENTS

| | | |
|---|---|---|
| JP | 61253318 | 11/1986 |
| JP | 1272715 | 10/1989 |
| JP | 3170612 | 7/1991 |
| JP | 5171251 | 7/1993 |
| JP | 11080828 | 3/1999 |
| JP | 2000313915 | 11/2000 |
| JP | 2004256881 | 9/2005 |
| WO | 2004466391 | 6/2004 |
| WO | 2007021207 | 2/2007 |

* cited by examiner

DEGASSER SNORKEL WITH SERPENTINE FLOW PATH COOLING

This application is a continuation-in-part of U.S. application Ser. No. 13/466,462, filed May 8, 2012, now U.S. Pat. No. 9,038,867, which claims the benefit of U.S. Provisional Application No. 61/484,871, filed May 11, 2011, the contents of all of which are hereby incorporated by reference in their entirety.

BACKGROUND OF THE INVENTION

Field of the Invention

The presently disclosed invention relates to an apparatus for making low carbon steel and, in particular, improved snorkels for conveying molten metal between the ladle and a vacuum vessel.

Discussion of the Prior Art

For many years it has been known that workability of steel can be significantly improved by decreasing the carbon content of the steel. More recently, there has been a growing demand for low carbon steel. In some applications such as thin gauge steel that is used in automotive applications, it is preferred to use ultra low carbon steel in which the carbon content is reduced to about 0.005%.

In the process for making ultra low carbon steel known as the RH process, the carbon content of the steel is reduced by lowering the partial pressure of carbon monoxide at the surface of the molten metal. More specifically, the molten metal is drawn from the steel ladle into a vacuum vessel that is located above the ladle. It is known in the art to locate two snorkels at ports in the bottom of the vacuum vessel and that extend downwardly toward the steel ladle. The snorkels are sufficiently long that when the vacuum vessel and the steel ladle are brought vertically closer together, the free ends of the snorkels extend into the steel ladle to an elevation below the normal surface of the molten metal.

One of the snorkels designated as the "up leg snorkel" incorporates passageways for an inert gas such as argon. At times when the free end of the up leg snorkel is below the surface of the molten metal in the ladle and a partial vacuum is established in the vacuum vessel, inert gas is injected into the molten steel inside the up leg snorkel to support the upward movement of the molten steel through the up leg snorkel and into the vacuum vessel. This also creates turbulence in the molten metal to increase the efficiency of the process by increasing the rate of carbon removal. Molten metal in the vacuum vessel then re-enters the steel ladle through the "down leg" snorkel.

Processing time for circulation of the molten metal through the vacuum vessel is typically about thirty minutes. During that time, the snorkels are exposed to the molten metal so that the temperature of the snorkels significantly increases. Molten metal is located both inside and outside the snorkels so that heat from the molten metal penetrates the snorkels both from the inner bore and from the outer surface.

Typically, the snorkels are constructed of a steel shell with the surface of the inner bore and the outer surface of the snorkel protected by refractory materials. The coefficient of thermal expansion of the steel shell is greater than the coefficient of thermal expansion of the refractory materials. Therefore, prolonged heating of the snorkel has resulted in cracks in the outer layer of refractory concrete. The refractory cracks allow subsequent penetration of the molten steel.

Unless the snorkel is taken out of service and the refractory concrete repaired or replaced, the cracks will ultimately lead to catastrophic failure of the snorkel.

Similarly, the inner refractory material is a brick layer. The brick layer is steadily eroded by the turbulent action of the molten metal caused by the injection of the inert gas. As the brick layer grows thinner, the rate of heat transference from the molten metal to the steel shell increases. Again, unless the snorkel is taken out of service and the brick layer repaired or replaced, the brick layer will present an insufficient thermal barrier and lead to catastrophic failure of the snorkel. Accordingly, it was recognized in the prior art that systems or methods for retarding the rate of heating of the steel shell in the snorkels would advantageously increase the number of heats in which a snorkel could be used without taking it out of service for repairs.

In some prior art snorkels, an array of pipes has been secured to the surface of the steel shell. The pipes are used to convey a cooling medium such as air to and around the steel cylinder to retard temperature increases of the steel cylinder during times that the snorkel is exposed to the molten metal. This arrangement has had some success, but its capability is limited in certain important respects. One significant limitation has been that the cooling capacity is proportional to the volume of cooling medium that is exposed to the steel cylinder. In the prior art, the volume of cooling medium is limited by the size of the pipes in the piping array. The size of the pipes used for conveying cooling medium, and thus the cooling capacity, is limited by the physical geometries of the snorkel.

An example of such prior art snorkels that is shown and described in JP Publication 2004256881 includes inner and outer concentric tubes with refractory materials on the inside of the inner tube and on the outside of the outer tube. Cooling gas is delivered through ports in the outer tube to a space between the concentric tubes. Fins that are oriented parallel to the longitudinal axis of the tubes are secured to surfaces of the inner and outer tubes that define the concentric space therebetween. The fins convey heat from the inner and outer tubes and thereby enlarge the effective area for dissipating heat to the cooling gas that flows through the space between the tubes.

JP Publication 11080828 shows another prior art snorkel in which concentric double tubes include a helical-shaped pipe in the space between the tubes. The flow of cooling gas between the double tubes is augmented by cooling water that is pumped through the pipe to transfer heat away from the tubes. Alternatively, the space between the tubes can include plates that are oriented generally parallel with the longitudinal axis of the tubes and arranged in an alternating fashion such that the plates form a pattern of openings that alternate between the top and bottom ends of the space. The pattern of openings results in a vertically undulating flow of cooling air through the space.

Such prior art designs tended to oppose the vertical thermal convection of the heated air. Also, these designs allowed only a unitary flow path for the cooling air throughout the interstitial space between the concentric tubes.

Also, improved safety features in degasser snorkels would be desirable. For example, some prior art designs proposed the use of water as a cooling medium. While using water may offer certain advantages in terms of thermal transfer capabilities, it also creates a severe explosion hazard in the event that the water should escape the cooling system and be directly exposed to the molten steel. Furthermore, water-based systems had inherent limitations in that, among other reasons, they were typically designed to work at relatively low pressures to maintain laminar flow through the system. Although higher pressures would have improved thermal transfer capability, it was found that higher pressures caused turbulence in the flow of the cooling water and resulted in dead spots in the flow path. Such dead spots were undesirable in that they caused the accretion of particulates and precipitates that tended to obstruct the flow path.

Systems that used an air cooling medium avoided the explosion risks of liquid systems, but are less efficient in transferring heat out of the snorkel. To improve efficiency, air-based systems sometimes proposed higher pressures that would create turbulence in the air flow. The turbulent air flow through the cooling passages would better convey heat, but the higher pressures created a high risk that air would escape the cooling passageways of the snorkel and become exposed directly to the molten steel so as to cause an explosion. Accordingly, air systems that operated at lower pressures would be preferred. However, to maintain adequate thermal capacity for the snorkel, the lower pressure air systems typically required larger passageways. In many cases, the snorkel became too bulky or structurally unsuited to accommodate adequate passageway geometries. Accordingly, there was a need in the prior art for a snorkel that had a cooling capability for an air medium that would operate are relatively low pressure.

Accordingly, there was a need in the prior art for an apparatus that could more effectively cool the steel cylinder of the snorkel without otherwise compromising the performance of the apparatus and method for making ultra low carbon steel.

SUMMARY OF THE INVENTION

In the presently disclosed invention, a snorkel for use with a reaction vessel for degassing molten metal includes a first shell with a longitudinal section that may be in the general shape of a cylinder. The snorkel further includes a second shell with a longitudinal section that also may be in the general shape of a cylinder, the second shell being located radially outside of the first shell so that the first and second shells define an annular gap between the outer surface of the first shell and the inner surface of the second shell. A refractory lining is secured to the outer surface of the second shell. Another refractory lining is secured to the inner surface of the first shell such that the opposite, free surface of the refractory lining defines a passageway through the interior of the snorkel. An array of baffles is located in the annular gap between the outer surface of the first shell and the inner surface of the second shell. The baffles may be oriented generally orthogonally to the longitudinal direction of the first and second shells, each of said baffles extending in an angular direction through an arc portion of said annular gap. Longitudinally adjacent baffles alternate two angular positions of the annular gap. The baffles cooperate with longitudinally extending members to create openings between the passageways that are formed between longitudinally adjacent baffles. The openings between the passageways are at one end of the passageway such that the openings and passageways combine to define a serpentine passageway through the annular gap. The serpentine passageway is in fluid communication with an input port and an output port such that there is a pathway for cooling medium flowing into the input port to pass through the serpentine passageway and out of the output port.

Preferably, the array of baffles includes a plurality of arcuate baffles. In addition, the snorkel includes at least two primary members that also are located between the first and second cylinders. The primary members are generally oriented in the direction of the longitudinal axis of the annular gap and at different angular positions of the annular gap. The primary members cooperate with the outer surface of the first shell and the inner surface of the second shell to define at least one passageway from one longitudinal end of the annular gap to the opposite longitudinal end of the annular gap so that the passageway is generally aligned parallel to the longitudinal direction of the annular gap. Each of the arcuate baffles is generally oriented orthogonally to the longitudinal axis of the annular gap between the first and second shells and between first and second angular positions about the longitudinal axis of the annular gap. One end of each of the arcuate baffles is connected to one of the primary members and the other end of the arcuate baffles is a free end that is spaced apart from a primary member to define a flow path between a primary member and the free end of the arcuate baffle.

More preferably, a plurality of pipes is secured to the first shell. Each of the pipes has in inlet for receiving inert gas and also has a diffused outlet by which inert gas percolates from the diffused outlet and into the inner passageway of the snorkel that is defined by the inner refractory layer.

Also preferably, the snorkel includes a flange for securing the snorkel to the vacuum vessel. The flange includes an internal passageway with a fluid inlet and a fluid outlet in communication with the internal passageway. Additionally, the internal passageway includes an input port and an output port that provide communication between the internal passageway and the annular gap. A dividing wall is located in the internal passageway between the fluid inlet and the fluid outlet so that cooling medium flowing through the internal passageway passes through the input port and into the annular gap, around the baffles, out of the annular gap through the output port, and into the internal passageway.

Preferably, where the snorkel includes a flange having an internal passageway with a fluid inlet and a fluid outlet that are in communication with the annular gap between the first and second shells, the snorkel can accommodate relatively large air supply pathways that are compatible with relatively low operating pressures.

Other objects and advantages of the presently disclosed invention will become apparent to those skilled in the art as the description of a presently disclosed embodiment of the invention proceeds.

BRIEF DESCRIPTION OF THE DRAWINGS

A presently preferred embodiment of the disclosed invention is further described herein in connection with the accompanying drawings in which.

DESCRIPTION OF A PRESENTLY PREFERRED EMBODIMENT OF THE DISCLOSED INVENTION

Figure 1:
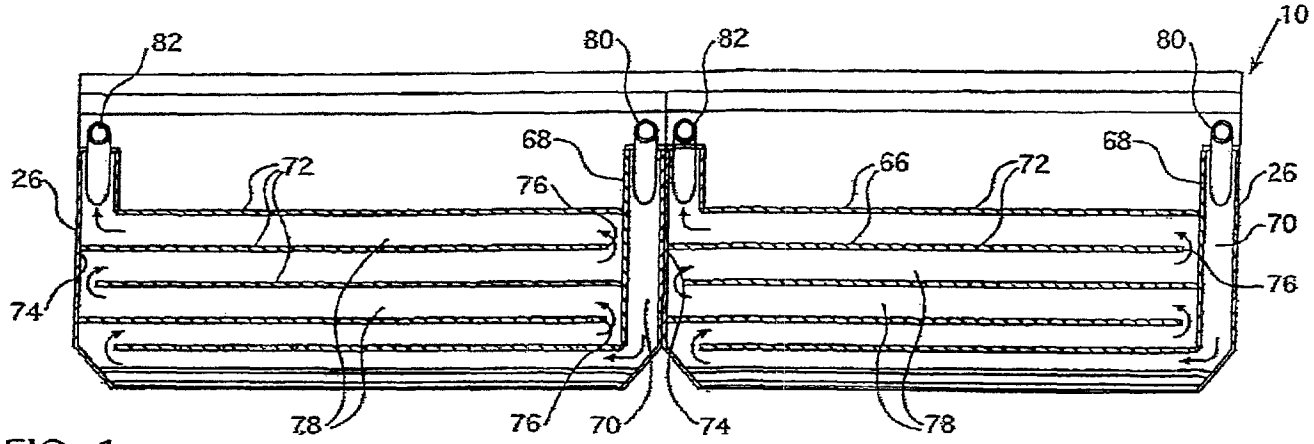
FIG. 1 is an elevation view of the snorkel in accordance the disclosed invention in which the baffle array of the snorkel is vertically bisected and opened along one side of the outer shell show two parallel circuits of a serpentine flow path for conveying cooling medium through the annular gap defined between the first and second shells of the snorkel.
Figure 2:
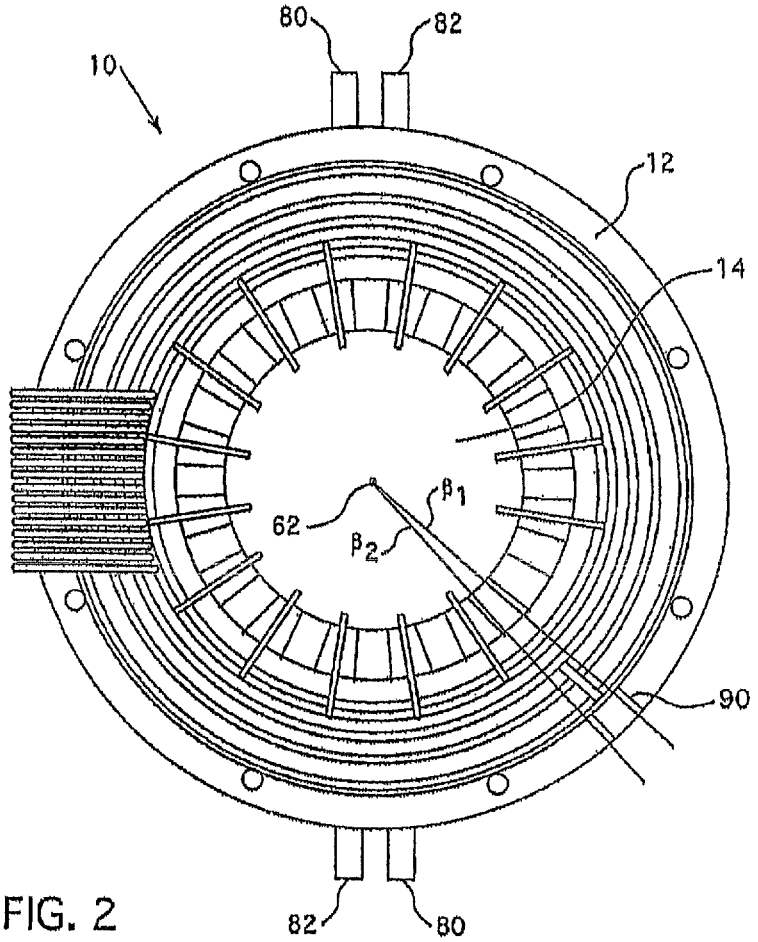
FIG. 2 is a plan view of the snorkel shown in FIG. 1, but with the snorkel in its normal, non-bisected position.
Figure 3:
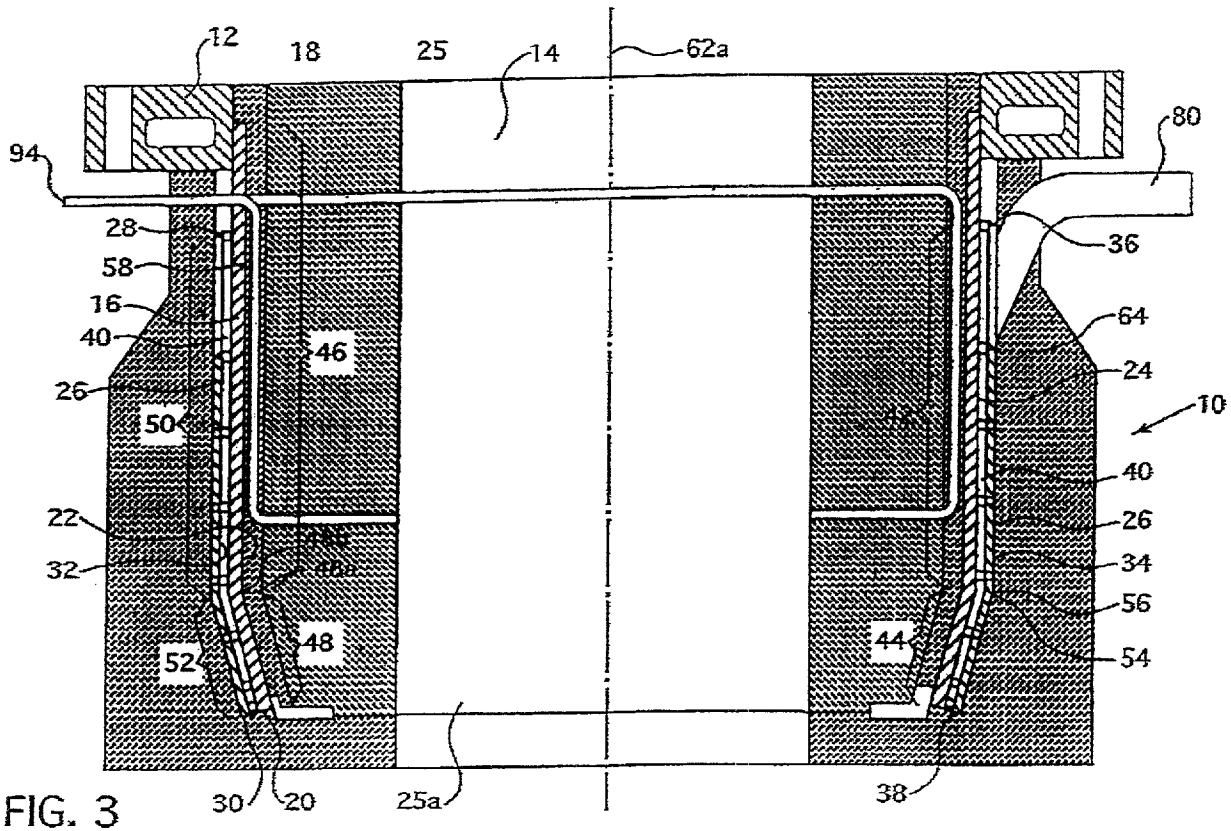
FIG. 3 is an elevation cross-section of the snorkel shown in FIGS. 1 and 2 with the first and second shells of the snorkel shown in cross-section.

As shown in FIGS. 1-3, a snorkel generally indicated as 10 is arranged for use with a reaction vessel (not shown) in a metal degassing process. The snorkel provides two parallel air flow circuits, each circuit having a serpentine flow path for cooling medium. The serpentine flow path allows improved cooling of the snorkel at times when it is exposed to molten metal. Snorkel 10 includes a flange 12 that is used to connect the snorkel to the reaction vessel. Flange 12 has a top surface 12*a*, an inner surface 12*b*, and a lower surface 12*c*. The interior of snorkel 10 defines a passageway 14 that is in communication with the interior of the reaction vessel.

Snorkel 10 further includes a first shell 16 that is secured to flange 12 by fillet weld 17. First shell 16 defines a circular upper edge 18 and a circular lower edge 20 such that the first shell further defines a closed inner surface 22 between upper edge 18 and lower edge 20. First shell 16 also defines a closed outer surface 24 between upper edge 18 and lower edge 20.

Snorkel 10 also includes a second shell 26 that defines a circular upper edge 28 and a circular lower edge 30 such that the second shell further defines a closed inner surface 32 and a closed outer surface 34 between the circular upper and lower edges 28 and 30.

Second shell 26 is located concentrically with respect to the first shell 16 with the outer surface 24 of first shell 16 opposing the inner surface 32 of second shell 26 to define an annular gap 40 between surfaces 24 and 32.

In the example of the preferred embodiment, first shell 16 has a first section 46 that is in the general shape of a cylinder and a second section 48 that is in the general shape of a truncated cone with the largest diameter, or base, 48*a* of the truncated cone being joined with a longitudinal end 48*b* of first section 46. Similarly, in the preferred embodiment second shell 26 has a first section 50 that is in the general shape of a cylinder and a second section 52 that is in the general shape of a truncated cone with the largest diameter, or base, 54 of the truncated cone being joined with a longitudinal end 56 of first section 50. First section 50 of second shell 26 is oriented concentrically outside of first section 46 of the first shell 16 and second section 52 of second shell 26 is oriented concentrically outside the second section 48 of the first shell 16. Correspondingly, annular gap 40 includes upper region 42 between first section 46 of the first shell and first section 50 of the second shell. Annular gap 40 also includes a lower region 44 between the second section 48 of said first shell and the second section 52 of the second shell.

Alternatively some snorkels do not include a truncated cone section with the full shell being a right circular cylinder. The truncated cone shape at the lower, or distal, end of the first and second shells 16, 26 is sometimes used to compensate for thermal expansion of the lower distal, ends of the first shell 16 and the second shell 26 (which are remote from flange 12) at times when snorkel 10 is immersed in molten metal. It is thought that this shape sometimes compensates for a "trumpeting" effect of the distal ends of first shell 16 and second shell 26 caused by thermal expansion of the shells while the snorkel is immersed in molten metal.

However, an alternative embodiment of the presently disclosed invention can include first shell 16 and second shell 26 in which the shells are only generally cylindrical as in section 46 of first shell 16 and section 50 of second shell 26. In that embodiment, the first and second shells have sections in the shape of a right circular cylinder. This alternative embodiment is possible in accordance with the presently disclosed invention because the serpentine air flow pathway that is subsequently described herein is effective to control thermal expansion of the distal portion of first shell 16 and second shell 26 so as to avoid "trumpeting."

Referring again to the embodiment of FIGS. 1-3, refractory lining 58 is secured to the inner surface 22 of the first shell 16 by a layer of refractory concrete 59. Refractory lining 58 extends longitudinally from a position that is substantially the same as the longitudinal position of top surface 12*a* of flange 12 to a position that is substantially the same longitudinal position as retainer 59*a* that is secured to first shell 16 adjacent lower edge 20. Refractory lining 58 has an inner surface 60 that defines a longitudinal passageway 62 through snorkel 10. Preferably, longitudinal passageway 62 is aligned with a center axis 62*a* that intersects the center points of the circular upper edge 18 and the circular lower edge 20 of the first shell 16.

Refractory concrete layer 59 extends longitudinally past the upper edge 18 of first shell 16 and covers upper edge 18 and fillet weld 17 and contacts the inner surface 12*b* of flange 12. Refractory concrete layer 59 thus cooperates with refractory lining 58 and the top surface of flange 12 to provide a smooth planar surface for contacting and sealing the snorkel against the reactor vessel.

A second refractory lining 64 is secured to the outer surface 34 of the second shell 26. Lining 64 extends in a radial direction away from the outer surface 34 of the second shell 26 by a sufficient dimension so that lining 64 is sufficient to protect the outer shell 26 from overheating at times when the snorkel 10 is immersed in molten metal. Lining 64 extends from a longitudinal position that is substantially the same as the position of the lower surface 12*c* of flange 12 to a position longitudinally beyond the lower edge 30 of the second shell 26. Additionally, at longitudinal positions beyond the longitudinal position of the retainer 59*a* and refractory lining 58, lining 64 extends radially inwardly from outer shell 26 to contact retainer 59*a* and the longitudinal end position of refractory lining 58. This refractory structure protects the distal ends of first shell 16 and second shell 26 from overheating at times when the snorkel 10 is immersed in molten metal.

In accordance with the presently disclosed embodiment, two arrays of baffles 66 are located in the annular gap 40 between outer surface 24 of first shell 16 and the inner surface 32 of the second shell 26. In the presently preferred embodiment, one array of baffles 66 is located in each opposite half of annular gap 40 that are defined by longitudinal members such as walls 67 and 67*a* that extend longitudinally through annular gap 40 and divide annular gap 40 into two separate chambers 67*b* and 67*c*. Each chamber 67*b* and 67*c* includes at least one primary baffle 68 and an array of baffles 66. Primary baffles 68 are located at different angular positions within annular gap 40 which angular positions are approximately 180° apart. Also, longitudinal members such as primary baffles 68 are longitudinally oriented in the direction of the longitudinal center axis 62*a* of passageway 62.

Primary baffles 68 cooperate with wall 67 or 67*a*, the outer surface 24 of the first shell 16, and the inner surface 32 of the second shell 26 to define a passageway 70 for conveying air or other cooling medium longitudinally through annular gap 40 from the upper region 42 of annular gap 40 to the lower region 44 of annular gap 40. Passageway 70 is generally aligned with the direction of passageway 62 between upper edge 18 and lower edge 20 of first shell 16.

The array of baffles 66 further includes at least two arcuate baffles 72 that are located in annular gap 40 at respective longitudinal positions along snorkel 10. Each arcuate baffle 72 has opposite ends 74 and 76 that are located in annular gap 40 at different angular positions about axis 62*a* so that arcuate baffles 72 define an arc between the ends 74 and 76. Arcuate baffles 72 in the array of baffles 66 are respectively located at different longitudinal positions of said annular gap. At least three longitudinally adjacent arcuate baffles cooperate with the outer surface 24 of the first shell 16 and the inner surface 32 of the second shell 26 to define at least two arcuate passageways 78 that are longitudinally adjacent to each other for conveying air or another cooling medium though annular gap 40 in an angular direction with respect to the longitudinal axis 62*a* of passageway 62.

Collectively, passageways 78 also convey the cooling medium in a longitudinal direction from the lower edge 20 of first shell 16 toward the upper edge 18 of first shell 16. One of ends 74, 76 of each arcuate baffle 72 is connected to one of the primary baffles 68 or to one of walls 67, 67*a*. The other of end 74, 76 of arcuate baffles 72 is a free end that is spaced apart from a primary baffle 68 and walls 67, 67*a*. Thus, a separate circuit or flow path is defined for each chamber 67*b*, 67*c*.

In the longitudinal direction through annular gap 40, each flow path passes through an opening between passageways that are located longitudinally adjacent to each other. The opening is defined by one of free ends 76 of arcuate baffle 72, one of the primary baffles 68 or walls 67, 67*a*, the outer surface 24 of the first shell 16, and the inner surface 32 of the second shell 26. At least one of the longitudinally oriented members 68, 67 or 67*a* are connected to the ends 74 of baffles 72 that are located longitudinally adjacent to and on opposite sides of a baffle 72 with a free end 76 that is spaced apart from the same longitudinal member 68, 67 or 67*a*. In this way, the longitudinal member 68, 67 or 67*a* cooperates with free end 76 of baffle 72 and with the outer surface 24 of first shell 16 and the inner surface 32 of the second shell 26 to define a vertical opening between two longitudinally adjacent passageways 78 to create a serpentine flow path through the passageways. The flow path through passageways 78 is thus in series because the flow is first through one passageway 78, then through the opening at one end of the passageway, and then through the second longitudinally adjacent passageway 78.

Stated differently, alternate baffles 72 in baffle array 66 have an end 74 that is connected to a longitudinally oriented member 68, 67 or 67*a*. The same longitudinal member 68, 67 or 67*a* also cooperates with the free end 76 of the other baffles in the baffle array 66, outer surface 24 of first shell 16, and inner surface 32 of second shell 26 to define openings between longitudinally adjacent passageways 78 to define a serpentine flow path between a passageway 78 at one longitudinal position of annular gap 40 and another passageway 78 at a second longitudinal position of annular gap 40.

The flow path thus established communicates through openings between vertically adjacent arcuate passageways 78. One end 74 of each of vertically adjacent arcuate baffles 72 is connected to a different longitudinally oriented member such as primary baffle 68 or wall 67, 67*a* so that the flow path through annular gap 40 follows a serpentine pathway from the lower region 44 of the annular gap 40 to the upper region 42 of the annular gap 40 as illustrated in FIGS. 1-3.

It has been found that location of the baffles is important to limit air flow restriction through annular gap 40. Preferably, the pattern for baffles is machined into the inner surface 32 of second shell 26 and the outer surface 20 of first shell 16 prior to forming shells 16 and 26. Appropriate spacing of the baffles will allow a flow of cooling air in the range of 100 to 800 scfm. Achievable minimum flow rates have been found to be three hundred scfm at ninety psi.

In some embodiments, snorkel shells without the disclosed air cooling have been found to reach temperatures of approximated 2000° F. In contrast, the air-cooling structure has been found to maintain shelf temperatures at about the exit temperature of exhausted air. In the test results shown in Table 1 below, this was 350° F. A typical heat removal for the presently disclosed multi-circuit air flow has been found to be 3,222 BTUM at conditions specified in Table 1.

TABLE 1

| Flow at Exit SCFM | Temperature inlet ° F. | Temperature outlet ° F. | Specific Weight (lb/ft3) | ACFM Exit acf/1-Lb/° F. | Heat Removal BTUM |
|---|---|---|---|---|---|
| 600 | 60 | 350 | 0.0759 | 20.53 | 3,222 |

Tables 3 and 4 show certain temperature measurements of a snorkel with the disclosed air-cooling system in contrast to a snorkel without such air-cooling. More specifically, Table 3 shows the temperature drop of a snorkel without air cooling after it has been immersed in a molten bath, heated to temperature, and then withdrawn from the bath. The temperature is measured over time as shown in Table 3 at two locations on the snorkel—one location at the slag line and the other location about eight inches from the bottom of the snorkel.

Using the temperature measurements of Table 3 as a benchmark, the snorkel with the disclosed air cooling structure was similarly immersed in a molten bath, heated to temperature, and then withdrawn from the bath. The snorkel temperature was measured at the same two corresponding locations that were used in the case of Table 3. However, in the case of Table 4, the air cooling system for the snorkel was operating.

TABLES 3 and 4

| | Measurement Point | | | |
|---|---|---|---|---|
| | Sp2 | | Sp3 | |
| Time (sec.) | Temp. (° F.) | Drop (° F.) | Temp. (° F.) | Drop (° F.) |
| Without Air Cooling | | | | |
| 0 | 1355.2 | | 1420.3 | |
| 89 | 1334 | −21.2 | 1349.8 | −70.5 |
| 210 | 1299.4 | −55.8 | 1296.3 | −124 |
| 333 | 1247.1 | −108.1 | 1259.3 | −161 |
| 457 | 1206.7 | −148.5 | 1237.8 | −182.5 |
| 572 | 1173.3 | −181.9 | 1217.1 | −203.2 |
| 683 | 1139.4 | −215.8 | 1174.7 | −245.6 |
| With Air Cooling | | | | |
| 0 | 1462.4 | | 1494.9 | |
| 132 | 1308.7 | −153.7 | 1230.4 | −264.5 |
| 252 | 1194.4 | −268 | 1049.4 | −445.5 |
| 370 | 1183.6 | −278.8 | 1057.6 | −437.3 |
| 490 | 1099.6 | −362.8 | 926.2 | −568.7 |

TABLES 3 and 4-continued

| | Measurement Point | | | |
|---|---|---|---|---|
| | Sp2 | | Sp3 | |
| Time (sec.) | Temp. (° F.) | Drop (° F.) | Temp. (° F.) | Drop (° F.) |
| 610 | 993.5 | −468.9 | 886.4 | −608.5 |
| 730 | 904.7 | −557.7 | 690.8 | −804.1 |

Figure 8:
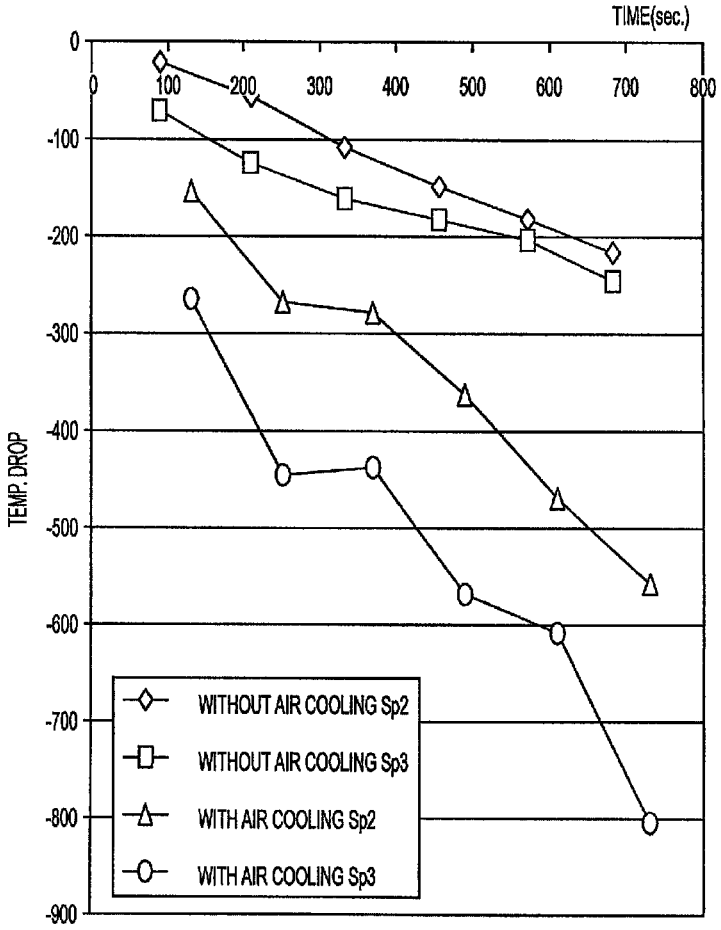
FIG. 8 is graph showing temperature measurements set forth in Tables 3 and 4.

The tabular results of Tables 3 and 4 are shown in FIG. 8. There it is clearly shown that the magnitude and rate of the temperature drop over the same time span is far greater in the case of the disclosed air-cooled snorkel.

Table 5 discloses temperature measurements that were taken on air-cooled snorkels as herein disclosed that was used through 23 separate heats. Again in Table 5, the snorkel temperature was measured at two separate locations—at the slagline and approximately eight inches from the bottom of the snorkel. For each heat, the snorkel temperature was measured over a five minute period following the time that it was withdrawn from the molten bath.

TABLE 5

| | Slagline - Port A Passage/Temp Drop | | | | | approx. 8" from bottom - Point B Passage/Temp Drop | | | | |
|---|---|---|---|---|---|---|---|---|---|---|
| Heat | 1 min | 2 min | 3 min | 4 min | 5 min | 1 min | 2 min | 3 min | 4 min | 5 min |
| 2 | | | −500 | | −570 | | | −565 | | −727 |
| 3 | −350 | −327 | | | | −342 | −503 | | | |
| 4 | −514 | −655 | | | | −373 | −568 | | | |
| 5 | −375 | −396 | | | | −322 | −445 | | | |
| 6 | −138 | −345 | −520 | −352 | −357 | −291 | −445 | −677 | −562 | −757 |
| 7 | −337 | −294 | | −453 | −401 | −255 | −378 | −458 | | −559 |
| 8 | −324 | −245 | −243 | −162 | −298 | −2 | −228 | −420 | −543 | −596 |
| 9 | | | | −62 | −403 | −133 | −270 | −362 | −485 | −601 |
| 10 | −199 | −127 | −266 | | | −187 | −238 | −257 | | |
| 11 | −253 | −186 | −179 | −304 | | −260 | −375 | −432 | −484 | |
| 12 | −98 | −183 | | | | −136 | −207 | | | |
| 13 | −18 | −350 | −453 | | | −110 | −229 | −322 | | |
| 14 | −124 | −279 | −324 | | | −119 | −212 | −273 | | |
| 15 | −138 | −40 | −497 | −287 | −467 | 0 | −356 | −550 | −494 | −570 |
| 16 | −154 | −386 | −220 | −265 | | −417 | −613 | −758 | −835 | 0 |
| 17 | −213 | −250 | −277 | −350 | −483 | −283 | −394 | −429 | −604 | −665 |
| 18 | −287 | −392 | −456 | −324 | −460 | −338 | −509 | −604 | −659 | −706 |
| 19 | −317 | −320 | −401 | −504 | −578 | −317 | −477 | −562 | −677 | −757 |
| 20 | −145 | −418 | −604 | −703 | −694 | −138 | −316 | −440 | −529 | −604 |
| 21 | | | | | | | | | | |
| 22 | −64 | −161 | | | | −492 | −656 | | | |
| 23 | −109 | −269 | −404 | −420 | −568 | −456 | −594 | −699 | −777 | −453 |
| Ave | −235 | −293 | −235 | −351 | −453 | −248 | −400 | −482 | −614 | −665 |

The serpentine pathway herein disclosed maximizes the cross-sectional area of the flow path through annular gap 40 for the cooling medium. It has been found that the presently disclosed apparatus affords approximately 20 times greater cross-sectional area flow for the cooling medium than cooling pipes known in the prior art. This has resulted in a rate of heat transfer away from first shell 16 and second shell 26 that is substantially 10 times the rate of heat transfer of cooling apparatus known in the prior art.

Figure 9:
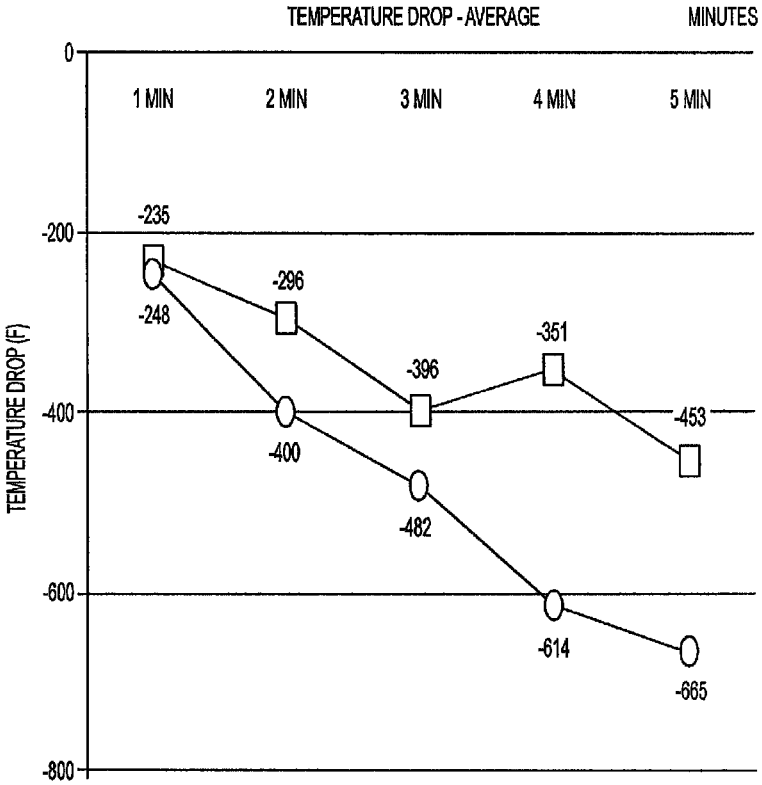
FIG. 9 is a graph showing the effect of air-cooled system on snorkel temperature.

As also shown in FIGS. 1-3, a fluid inlet 80 is in fluid communication with each passageway 70 in annular gap 40. When cooling medium is received at fluid inlet 80, it flows to the upper region 42 of annular gap 40. From upper region 42 the cooling medium flows through passageway 70 to the lower region 44 of annular gap 40, and then through the serpentine The tabular results of Table 5 are shown in FIG. 9 where it is clearly shown that the air-cooled system rapidly and diametrically reduced the snorkel temperature.

Figure 10:
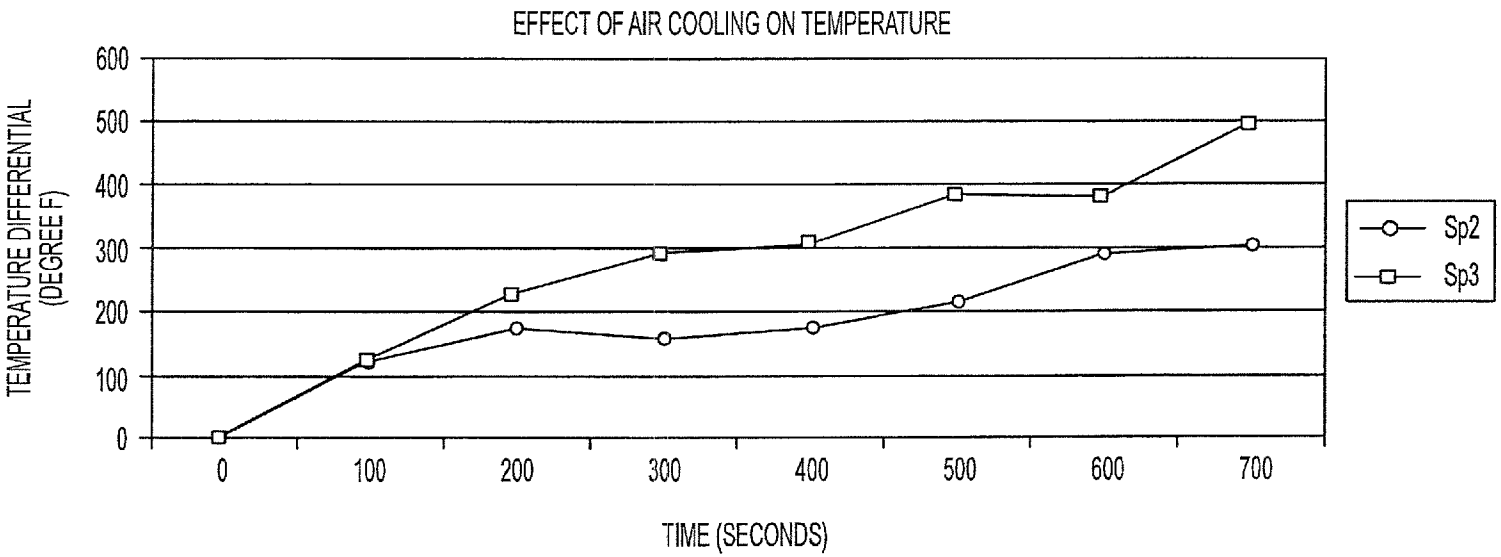
FIG. 10 is a graph showing the increase of snorkel temperature for a snorkel with the disclosed air cooling structure as it remains in a molten bath.

FIG. 10 shows the increase of snorkel temperature (again at the same two locations) for a snorkel with the disclosed air cooling structure as it remains in a molten bath. FIG. 10 shows that the temperature increase of the snorkel is relatively limited and at a relatively slow rate.

The serpentine pathway herein disclosed maximizes the cross-sectional area of the flow path through annular gap 40 for the cooling medium. It has been found that the presently disclosed apparatus affords approximately 20 times greater cross-sectional area flow for the cooling medium than cooling pipes known in the prior art. This has resulted in a rate of heat transfer away from first shell 16 and second shell 26 that is substantially 10 times the rate of heat transfer of cooling apparatus known in the prior art.

As also shown in FIGS. 1-3, a fluid inlet 80 is in fluid communication with each passageway 70 in annular gap 40. When cooling medium is received at fluid inlet 80, it flows to the upper region 42 of annular gap 40. From upper region 42 the cooling medium flows through passageway 70 to the lower region 44 of annular gap 40, and then through the serpentine pathway of passageways 78 as previously explained. In each chamber 67*b*, 67*c*, a fluid outlet 82 is in fluid communication with one of the passageways 78 in annular gap 40 that convey cooling medium angularly with respect to the longitudinal axis of passageway 62 such that cooling medium is exhausted through fluid outlet 82. In this way, inlet 80 is in fluid communication with outlet 82 through at least two passageways 78 that are arranged for fluid flow through the passageways in series-one after the other.

Cooling media flows simultaneously to fluid inlets 80 for each of the chambers of annular gap 40 such that cooling medium flows concurrently through the first and second chambers of the annular gap. This parallel flow of cooling medium through separate chambers or circuits of annular gap 40 increases the flow rate of the cooling medium to increase the rate of heat transfer away from the steel shells 16, 26 in comparison to apparatus in which the internal passageway includes only a single fluid inlet and a single fluid outlet. In alternative embodiments more than two parallel circuits could be used as will be apparent to those skilled in the art.

To assure against air leakage in the cooling circuits, it is preferable to submit the cooling circuit to a pressure test. In an embodiment, the pressure test includes a gauge that is linked to a computer. A typical standard for passage of such testing is zero leakage over a thirty minute period at ninety psi.

Alternatively to the embodiment of FIGS. 1-3, FIGS. 4 and 5 show an embodiment wherein flange 12 includes an internal passageway 84. Internal passageway 84 extends between a flange input ports 86 and 87 and a flange output ports 88 and 89. Cooling media passes through input port 87 through internal passageway 84 of flange 12 and exits the flange through the output port 88.

Internal passageway 84 of flange 12 is in communication with fluid inlets 80, 81 and fluid outlets 82, 83 such that the fluid pathway through annular gap 40 also includes passage of the cooling medium through the internal passageway 84 of flange 12. Preferably, the internal passageway 84 of flange 12 includes baffles 90, 90*a*, 91, and 91*a* that are located in the internal passageway 84 between input ports 86, 87 and output ports 88, 89. More specifically, baffle 90 is located between fluid inlet 80 and fluid outlet 82, baffle 90*a* is located between fluid inlet 81 and fluid outlet 83, baffle 91 is located between fluid inlet 81 and fluid outlet 82, and baffle 91*a* is located between fluid inlet 80 and fluid outlet 83.

Cooling media flows from the input port 86 to internal passageway 84 and from internal passageway through fluid inlet 81 to passageway 70 in the annular gap that is defined between the primary baffles 68. The cooling media then flows around arcuate baffles 72 in the first chamber and through fluid outlet 83 to internal passageway 84 and output port 89. Cooling media also flows from the second input port 87 to internal passageway 84 and from internal passageway 84 through fluid inlet 80 to a second passageway 70 of the annular gap that is defined between the primary baffles 68. The cooling media then flows around arcuate baffles 72 and through a second fluid outlet 82 to internal passageway 84 and second output port 88. In this way, cooling media flows from the internal passageway 84 and concurrently through the first and second chambers of the annular gap. This increases the flow rate of the cooling medium to increase the rate of heat transfer away from the steel shells 16, 26 in comparison to apparatus in which the internal passageway includes only a single fluid inlet and a single fluid outlet.

Figure 4:
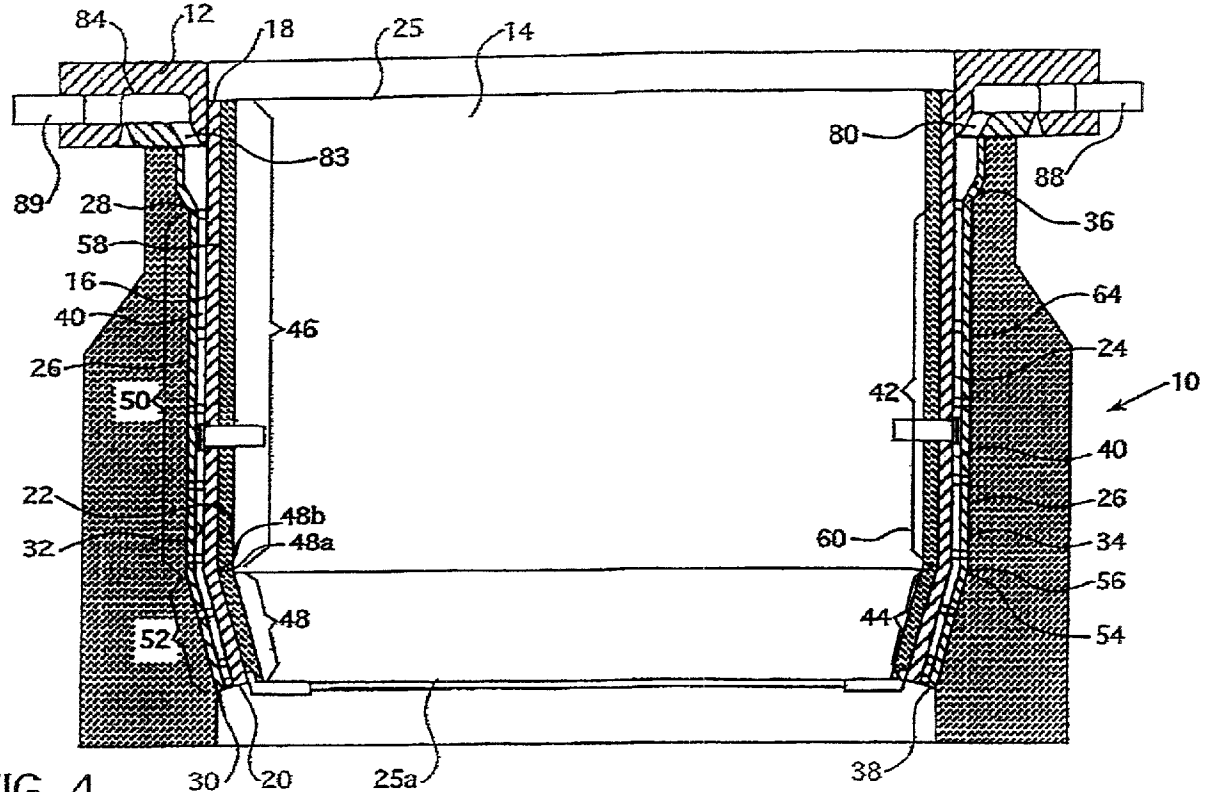
FIG. 4 is an elevation view of an alternative embodiment of the snorkel shown in FIGS. 1-3 wherein the flow path for conveying cooling medium extends from two parallel circuits for serpentine air flow into the flange that secures the nozzle to the reaction vessel.
Figure 5:
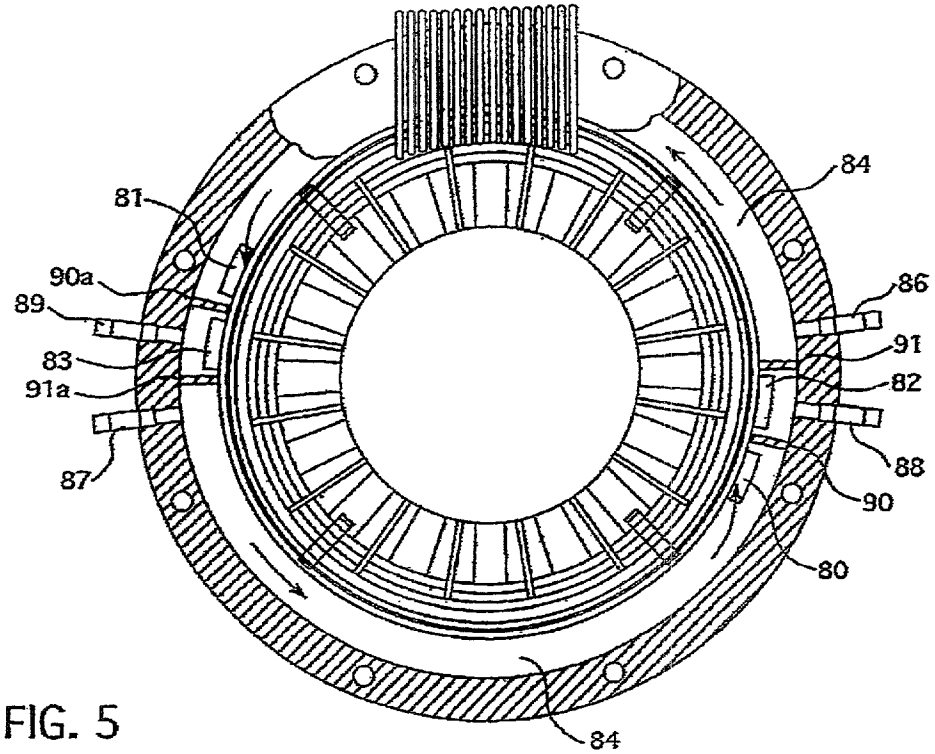
FIG. 5 is a plan view of the alternative embodiment of the snorkel shown in FIG. 4.

It has been found that the structure of the embodiment of FIG. 4 allows for more convenient connections to the relatively large air supply pipes such as approximately 1.5 in. because such pipes won't fit immediately adjacent and below the flange as in some embodiments. Also, the embodiment of FIG. 4 is advantageous because it cools the flange as well as the other portions of the snorkel. This is more protective of the flange because the flange is exposed to the cooler air. Also, this embodiment avoids connection to multiple inlets when the air cooled system incorporates multiple cooling circuits. Also, according to this embodiment, the inlets are located further from the molten bath than embodiments in which the supply air is provided below the flange and directly to the snorkel shells.

When the snorkel serves as the up snorkel, it further includes a plurality of pipes 92. Pipes 92 are secured in the layer of refractory concrete 59*a*. Each of pipes 92 has a respective inlet 94 for receiving an inert gas that can be injected into molten metal flowing in passageway 62. The inert gas supports the upward movement of steel from the ladle to the degasser vessel, and creates a turbulent condition inside the vessel that significantly increases the rate of carbon reduction during the RH process. Each of said pipes 92 further includes an outlet 96 for discharging the inert gas from the pipe 92 in a direction that is generally radially inward with respect to passageway 62. The inert gas passes into molten metal in the snorkel passageway from the inner surface 60 of the refractory lining 58.

Figure 6:
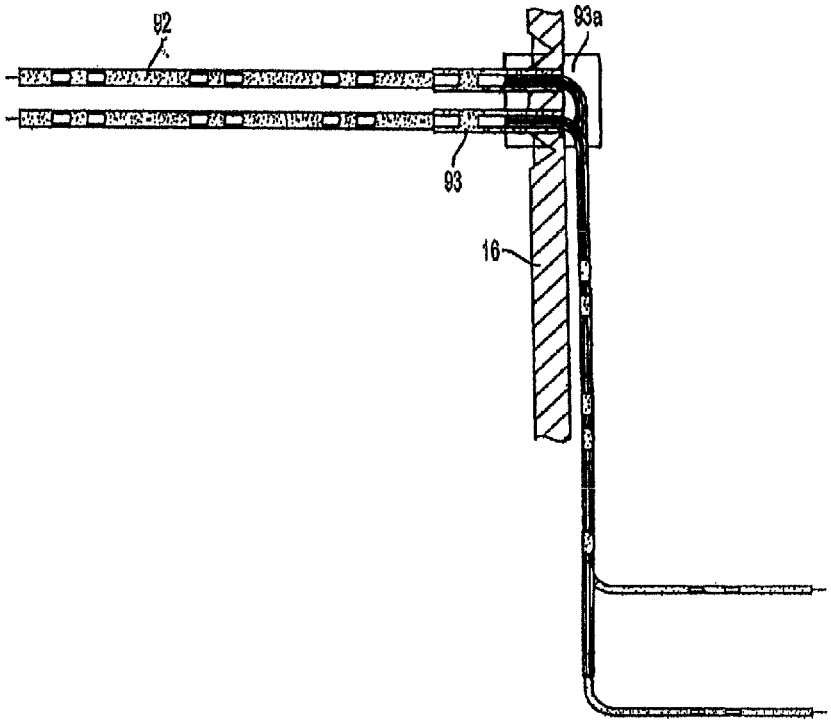
FIG. 6 is an enlarged portion of the cross-section of FIG. 3 detailing the passage of pipes through a shell of the snorkel for the injection of inert gas into steel in the internal passageway of the nozzle.

As shown in greater detail in FIG. 6, pipes 92 are sealed at first shell 16. Typically, first shell 16 may be Corten B grade steel of a ¾" to 1" thickness. In contrast, pipes 92 are typically ⅜" OD 310 stainless steel tubing with a wall thickness of only 0.065 in. The dissimilarity of the materials and thickness of pipes 92 and first shell 16 complicates the welding of these two ports to form an air-tight seal.

Accordingly, the presently disclosed invention includes a preliminary step of welding ⅜" schedule 80 stainless pipes 93 to the argon shell plenum plate 93*a* for each pipe. The ⅜" OD 0.065 in. wall thickness tubes are then threaded through each pipe 93 after which the plenum plate 93*a* is seal welded to first shell 16. An air seal is then created by tig welding the ⅜"OD tubes 92 to the pipes 93 on the outside.

It has been found that the horizontally oriented serpentine path herein disclosed obtains superior results in comparison to snorkel cooling mechanisms known in the prior art. As specifically shown in FIG. 7, the change in diameter of a snorkel shell having a diameter of 950-1000 mm is not more than 3 to 5 mm.

Figure 7:
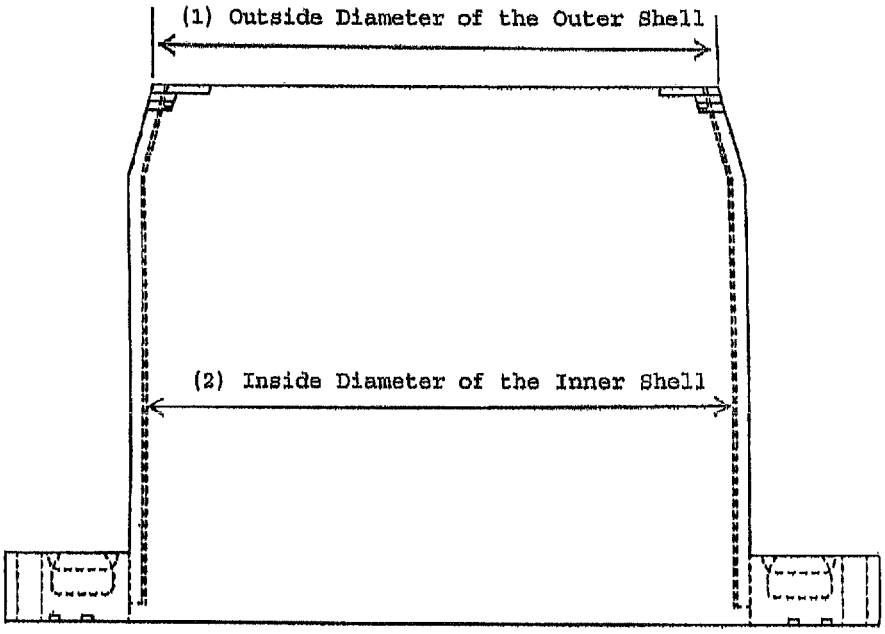
FIG. 7 is a cross-section of the inner and outer shells of the nozzle shown in FIG. 3 that illustrates the location and nominal dimension of the shells in connection with tables that are included in the specification.

More specifically, Tables 6 and 7 below show dimensions of an air cold snorkel as herein disclosed at the locations illustrated in FIG. 7. Table 6 corresponds to dimension (1) and Table 7 corresponds to dimension (2). Tables 6 and 7 are based on an air cooled snorkel that was used in 170 heats. It is shown then that after 170 heats, the air cooled snorkel charged only 5 mm (0.5%) at the outside diameter of the outer shell and that there was no measurable change in the inside diameter of the inner shell.

TABLE 6

| (1) | |
|---|---|
| | Dimension |
| Original | 972 mm |
| After usage | 977 mm |
| Change | 5 mm (0.5%) |

TABLE 7

| (2) | |
|---|---|
| | Dimension |
| Original | 975 mm |
| After usage | 975 mm |
| Change | No change |

TABLE 8

| (1) | |
|---|---|
| | Dimension |
| Original | 926.3 mm |
| After usage | 965 mm |
| Change | 38.7 mm (4.2%) |

TABLE 9

| (2) | |
|---|---|
| | Dimension |
| Original | 975 mm |
| After usage | 980 mm |
| Change | 5 mm (0.5%) |

As basis for comparison, Tables 8 and 9 show change in diameter of a conventional snorkel without the disclosed air cooling. Tables 8 and 9 are based on the diameter changes in the conventional snorkel after only 130 heats. In that case, the outside diameter of the outer shell (Table 8) increased 387.7 mm (4.2%) and the inside diameter of the inner hell (Table 9) increased 5 mm (0.5%).

This comparison shows that heat deformation of prior art snorkels causes the shells to trumpet outwardly at the distal end. This trumpeting phenomenon can be significant. In some cases it amounts to a change in diameter of the shell of as much as 150 mm. Such dramatic deformation causes substantial destruction of the refractory layers and premature failure of the snorkel.

From the forgoing description, other embodiments of the invention that is herein disclosed also will become apparent to those skilled in the art. Such embodiments are also included within the scope of the following claims.

We claim:

1. A snorkel for use with a reaction vessel for degassing molten metal, said snorkel comprising:

a first shell having an upper edge and a lower edge, said first shell defining a closed an outer surface and a closed an inner surface between said upper and lower edges;

a second shell having an upper edge and a lower edge, said second shell defining a closed an outer surface and a closed an inner surface between said upper and lower edges, said second shell being oriented outside said first shell with the outer surface of said first shell opposing the inner surface of said second shell to define an annular gap therebetween, said second shell having an inlet opening and an outlet opening that are in fluid communication with said annual gap;

a first refractory lining that is secured to the interior surface of said first shell;

a second refractory lining that is secured to the outer surface of said second shell;

an array of baffles, each baffle in said array of baffles being located in said annular gap between the outer surface of said first shell and the inner surface of said second shell and being located at a different respective longitudinal position of said annular gap, longitudinally adjacent baffles in said array cooperating with the outer surface of said first shell and the inner surface of said second shell to define at least first and second passageways, said inlet opening being in fluid communication with said outlet opening through said first passageway in series with said second passageway, at least one of said baffles having a free end;

at least one member that is longitudinally oriented in said annular gap and that is connected to the ends of at least two baffles that are positioned longitudinally adjacent to said baffle, having a free end such that said longitudinal member cooperates with the free end of said baffle and with the outer surface of said inner shell and the inner surface of said outer shell to define a vertical opening between said first passageway and said second passageway such that there is a serpentine flow path through said first and second passageways;

a fluid inlet that is in communication with said passageways; and a fluid outlet that is in communication with said passageways.

2. The snorkel of claim 1 further comprising a flange that is connected to said first shell.

3. The snorkel of claim 2 wherein said fluid inlet and said fluid outlet are in communication with said annular gap.

4. The snorkel of claim 3 wherein said flange includes a first internal passageway that is in fluid communication with an input port and that connects to said fluid inlet, said flange also including a second internal passageway that is in fluid communication with an output port and that connects to said fluid outlet such that cooling media that flows through said input port passes through said first internal passageway and exits said flange through said second internal passageway and said output port.

5. The snorkel of claim 4 wherein a barrier is located in the internal passageway of said flange between said inlet port and said output port such that cooling media flows from said internal passageway through said fluid inlet and into said annular gap, said cooling medium then flowing past the baffles of said array of baffles and through said fluid outlet back into the internal passageway.

6. The snorkel of claim 1 further comprising:

a plurality of pipes that are secured to said first shell, each of said pipes having an inlet for receiving a fluid and having a diffused outlet for percolating said fluid from the pipe and radially inward from the inner surface of the refractory lining that is secured to the inner surface of said first shell.

7. A snorkel for use with a reaction vessel for degassing molten metal by holding a partial vacuum on the molten metal, said snorkel being connectable to said reaction vessel and comprising:

a flange that is connectable to the reaction vessel, said flange including a first internal passageway that is in fluid communication with an input port, said flange also including a second internal passageway that is in fluid communication with an output port such that cooling media that flows through said input port passes through said first internal passageway and exits said flange through said second internal passageway and said output port;

a first shell that has an upper edge and a lower edge, said first shell defining a closed outer surface and a closed inner surface between said upper and lower edges, the upper edge of said first shell defining a first circular edge and the lower edge of said first shell defining a second circular edge;

a second shell with an upper edge and a lower edge, said second shell defining a closed outer surface and a closed inner surface between said upper and lower edges, the upper edge of said second shell defining a first circular edge and the lower edge of said second shell defining a second circular edge, said second shell being oriented concentrically with respect to said first shell with the outer surface of said first shell opposing the inner surface of said second shell and defining an annular gap between the outer surface of said first shell and the inner surface of said second shell;

a refractory lining that is secured to the inner surface of said first shell, said refractory lining having an inner surface that defines a passageway along a longitudinal axis that intersects the centerpoints of the first and second circular edges of said first shell;

a refractory lining that is secured to the external surface of said second shell; an array of arcuate-shaped baffles that is located in the annular gap between the outer surface of said first shell and the inner surface of said second shell, each of said arcuate-shaped baffles being located at a different longitudinal position of said annular gap, said arcuate-shaped baffles cooperating with the outer surface of said first shell and the inner surface of said second shell to define at least two arcuate passageways for conveying cooling medium through said annular gap, said arcuate-shaped baffles having one end that is a free end and also have a second end that is oppositely disposed from said free end;

at least one primary baffle that cooperates with the free end of at least one of said arcuate-shaped baffles, the inside of the second shell, and the outside of the first shell to define an opening in the longitudinal direction between longitudinally adjacent arcuate passageways, said primary baffle also connected to the second end of at least one of said arcuate-shaped baffles to block the flow of cooling medium longitudinally past said arcuate baffle, said arcuate-shaped baffles being longitudinally adjacent to each other in said array so as to define a serpentine flow path through said passageways;

a fluid inlet that is in communication with the at least one passageway for conveying cooling medium longitudinally through said annular gap, said fluid inlet also being in communication with said first internal passageway; and a fluid outlet that is in communication with one of said arcuate passageways for conveying cooling medium angularly with respect to the longitudinal axis of the passageway between the first and second openings of said first shell, said fluid outlet also being in communication with said second internal passageway of said flange.

8. The snorkel of claim 7 wherein said flange includes an internal passageway that is in communication with an input port and said fluid inlet and an internal passageway that is in communication with a fluid outlet and an output port such that cooling media that flows through said input port passes through said internal passageway, said fluid inlet, past said array of baffles, through said fluid outlet and said internal passageway, and exits said flange through said output port.

9. The snorkel of claim 8 wherein a barrier is located in the internal passageway of said flange between said inlet port and said output port such that cooling media flows from said internal passageway and through the fluid inlet into the annular gap, through the annular gap around said baffle array, and through said fluid outlet and back to said internal passageway.

10. The snorkel of claim 9 further comprising:

a second fluid inlet that is in communication with the passageway for conveying cooling medium longitudinally through said annular gap; and a second fluid outlet that is in communication with one of said passageways for conveying cooling medium angularly with respect to the longitudinally axis of the passageway between the first and second openings of said first shell;

a second input port in communication with said internal passageway and the annular gap;

a second output port in communication with said internal passageway and the annular gap; and a second a barrier that is located in the internal passageway of said flange between said second inlet port and said second output port such that cooling media flows from said internal passageway and through the second fluid inlet into the annular gap, through the annular gap around said baffle array, and through said second fluid outlet and back to said internal passageway.

11. The snorkel of claim 7 further comprising:

a plurality of pipes that are secured to said first shell, each of said pipes having an inlet for receiving a fluid and having a diffused outlet for percolating said fluid from the pipe and radially inward from the inner surface of the refractory lining that is secured to the inner surface of said first shell.

* * * * *